United States Patent [19]

Borodin

[11] 3,940,963

[45] Mar. 2, 1976

[54] SELF-COMPENSATING DIE

[75] Inventor: Daniel J. Borodin, Detroit, Mich.

[73] Assignee: New York Wire Mills Corporation, Tonawanda, N.Y.

[22] Filed: Jan. 20, 1975

[21] Appl. No.: 542,397

[52] U.S. Cl. ..... 72/78

[51] Int. Cl.[2] ..... B21B 1/18

[58] Field of Search ..... 72/11, 16, 78, 121, 98, 72/99, 100, 77

[56] References Cited

UNITED STATES PATENTS

| | | | |
|---|---|---|---|
| 321,478 | 7/1885 | Benton | 72/78 |
| 2,168,340 | 8/1939 | Hill | 72/78 |
| 3,379,042 | 4/1968 | Brown | 72/78 |
| 3,492,849 | 2/1970 | Marcovitch | 72/98 |

FOREIGN PATENTS OR APPLICATIONS

| | | | |
|---|---|---|---|
| 893,864 | 4/1962 | United Kingdom | 72/78 |

*Primary Examiner*—Lowell A. Larson
*Attorney, Agent, or Firm*—Price, Heneveld, Huizenga & Cooper

[57] ABSTRACT

The specification discloses a self-compensating die in which a plurality of roller sets mounted in a rotating rotor rotate about a wire passing through the rotor and compressively engage the wire to thereby reduce its diameter. A sleeve rotatable with the rotor but axially slidable with respect thereto includes cams which control the roller sets in response to adjusting signals from a control system to thereby automatically compensate the roller pressure applied in response to roller wear and other errors, and to thereby provide a means for adjusting the die for production of different sized wires from a wire of a given starting diameter.

39 Claims, 14 Drawing Figures

SELF-COMPENSATING DIE

BACKGROUND OF THE INVENTION

The present invention relates to dies for reducing wire diameter. Typically, such dies comprises an opening cut in a very hard compound through which wire is drawn. Tungsten carbide dies are commonly used in the industry. Usually, a plurality of such dies are arranged in a series such that a slight amount of reduction is effected at each different die. One cannot effect too great a reduction in any one die or the material will break.

The drawback to such dies and die systems include the fact that the dies eventually wear. As they do, error creeps in. When the error becomes too great, the operation must be shut down and the dies must be replaced with new dies.

Similarly, when different sized wire is to be produced, the operation must be shut down and the dies must be replaced or otherwise rearranged so that a different diameter will result when the operation is resumed. Accordingly, a plurality of dies of differing diameter apertures must be stocked by the manufacturer.

SUMMARY OF THE INVENTION

The present invention comprises a self-compensating die having rollers which compressively engage a wire passing therebetween and which rotate about the wire as the wire travels therebetween. Control means are provided to automatically change the pressure applied by the rollers in response to either a desire to change the diameter of wire produced or in response to error resulting from roller wear or other sources.

These and other objects, features, and advantages of the invention will be more fully appreciated by reference to the written specification and appended drawings.

DESCRIPTION OF THE PREFERRED EMBODIMENT

Figures 1, 2, 5:
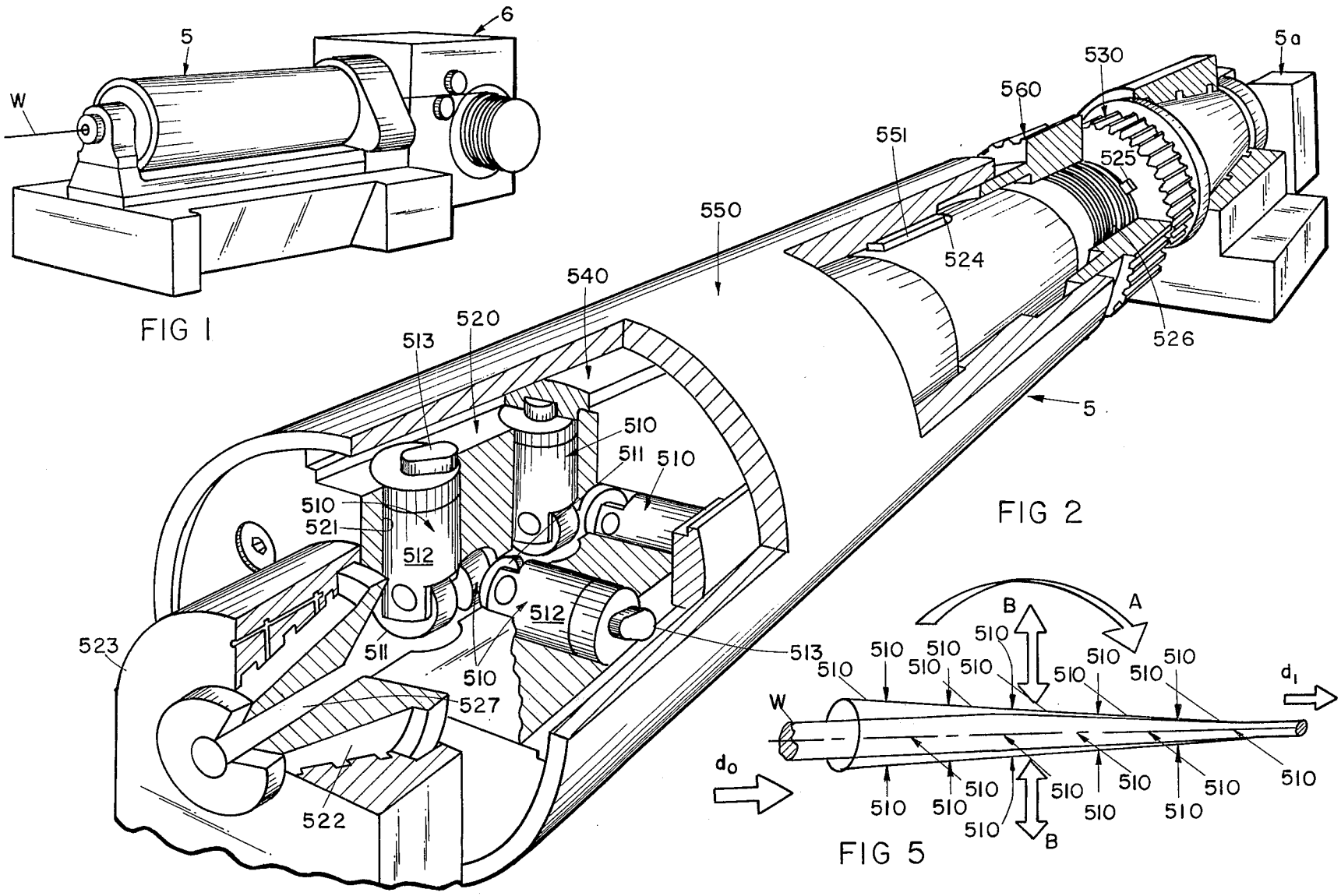
FIG. 1 comprises a perspective view of the self-compensating die 5 and its wire drive capstan 6.
FIG. 2 is a partially cut-away perspective view of the self-compensating die.
FIG. 5 is a schematic representation of the manner in which the rollers operate to decrease the diameter of wire W.

The self-compensating die 5 of the present invention includes a plurality of pairs of roller assemblies 510 carried in a rotating rotor 520 rotatably driven at one end through a rotor drive gear 530, which is itself ultimately driven by the drive capstan 6 (FIGS. 1–4). The angle of orientation of the roller assemblies and with respect to the wire passing therebetween (through the center of rotor 520) and the amount of pressure which the roller assemblies exert on that wire are controlled by cams 540 which are bolted to the inside of a sleeve 550 which surrounds rotor 520 and which is keyed for simultaneous rotation therewith by a key 551 slidably received in a keyway 524 in rotor 520. Sleeve 550 is slidable axially relative to rotor 520 and when so moved, cams 540 operate on roller assemblies 510 to change their angular orientation and their radial locations within rotor 520.

This axial adjustment is achieved by an adjusting gear 560 which is threadably received on rotor 520 at one end thereof and which is threadably received in sleeve 550 at one end thereof. Adjusting gear 560 is normally driven at the same rate of rotation as rotor drive gear 530. However, the pitch of the threads on rotor 520 and the pitch of the threads in sleeve 550 are different so that when a differential rotation is introduced through a drive and differential control assembly 570 (FIG. 3), adjusting gear 560 is rotated relative to rotor 520 and sleeve 550, thereby threadably moving on both and causing an axial shift of sleeve 550, and the cams 540 bolted thereto, with respect to rotor 520. This adjustment effected through differential assembly 570 is acheived as a result of a signal which compares the actual wire diameter $d_{1a}$ at electronic wire gauge 5a (FIGS. 2, 12, and 14) with the desired wire diameter $d_1$ which is originally programmed into the system.

The roller assemblies 510 are arranged in opposing pairs such that one pushes against one side of the wire and the other pushes against the other side (FIG. 2). Each roller assembly 510 includes a roller wheel 511, preferably made of a very hard steel material, a roller mounting cylinder 512, to the bottom of which each roller 511 is rotatably mounted, and a cam follower 513, for engaging cam 540, positioned atop cylinder 512. The top of cam follower 513 is gently crowned to prevent its brinelling cam track 541 of cam 540. Each cylinder 512 is both rotatable and movable radially (with respect to rotor 520) within rotor 520. This allows for adjustment of the angle of each roller 511 with respect to the lateral cross section of wire passing through the self-compensating die and it allows for adjustment of the radial position of each opposing pair of rollers 511 within rotor 520, relative to the center line axis of rotation of rotor 520.

As one proceeds along the length of self-compensating die 5 from the front to the rear thereof, the different opposing roller sets 510 are positioned progressively more closely together. The effect is that of creating a cone, although not strictly speaking necessarily a true cone, through which the wire W must pass. This cone effect is illustrated schematically in FIG. 5. In actual practice, the "cone" will be of disproportionately larger effective cone angle at the front of self-compensating die 5 than at the back, since the softer starting material can be reduced more rapidly than after it has already been reduced by earlier roller assemblies 510. The various roller pairs are illustrated by small arrows labeled with the number 510. The number of roller pairs indicated is not critical, although these should be at least about twelve pairs and there may be as many as thirty-two different pairs of opposing roller sets 510 in self-compensating die 5. The wire W enters the cone at an initial diameter $d_o$ indicated by the arrow at the left-hand side of FIG. 5. It is eventually engaged by opposing roller sets 510 and narrowed downwardly until it comes out of the opposite end of the cone at a diameter $d_1$. As the wire W is travelling in the direction of the arrows $d_o$ and $d_1$, the rollers 510 are rotating around the wire in the clockwise direction as is illustrated by the arrow A. The rotor 520 and the sleeve 550 rotate in such a way that the rollers 511 of roller assemblies 510 rotate into the wire as it proceeds towards them and at an angle with respect to the wire.

By shifting sleeve 540, the relative "height" of the roller assembly 510, or in other words the distance of the rollers 511 from the center line of the wire W, is varied. The effect is that of either expanding or contracting the cone as illustrated by the arrows B in FIG. 5. If the wire were to be reduced by the maximum amount of which self-compensating die 5 is capable, the cone of FIG. 5 would be contracted inwardly until all of the rollers 511 of all of the roller assemblies 510 engage the wire W. For smaller reductions, the cone is expanded outwardly and in some circumstances, many of the rollers 511 towards the front of self-compensating die 5 will never contact the wire W passing therethrough.

Figure 7:
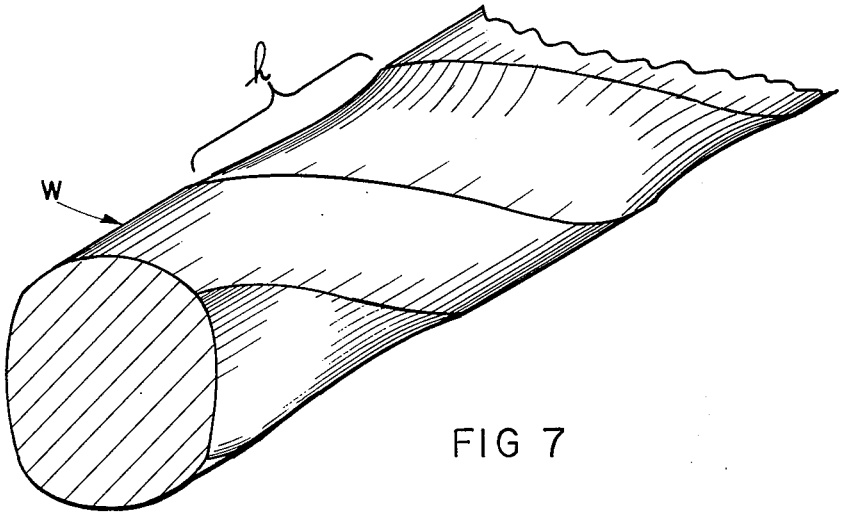
FIG. 7 is a perspective illustration of what the wire W would look like after passing through the self-compensating die if the self-compensating die included only one set of oppositely facing rollers.

The rollers 511 rotate into wire W as it travels towards them, only they do so at an angle by reason of the rotation of rotor 520. If there were only one pair of opposed rollers 511, they would create a helical path h on the surface of wire W as shown in FIG. 7. At any point, the cross section of wire W would be somewhat like a television screen. Successive roller pairs are oriented at different angles with respect to preceding pairs to eventually roll out these high points so that the wire finally leaving die 5 is round in cross section. The roller pairs 510 shown in FIGS. 2 and 5 are oriented successively at right angles, but other angles could conceivably be operable.

Figure 6:
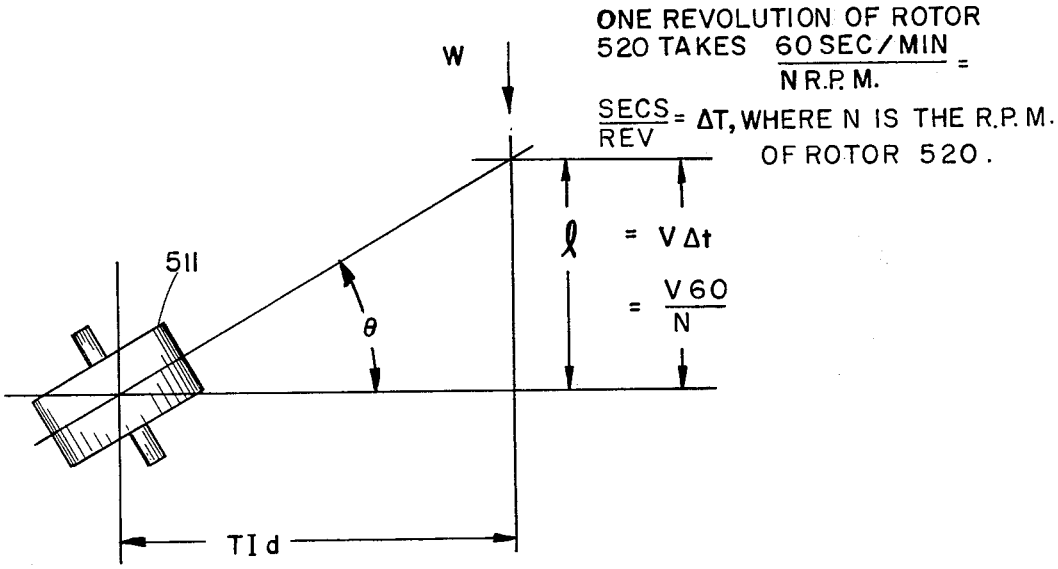
FIG. 6 is a schematic diagram illustrating the calculation of the angle $\theta$ which the rollers must make relative to the longitudinal axis of the wire passing through the self-conpensating die.

The angle $\theta$ at which each roller 511 must be oriented with respect to the lateral cross section of the wire in order that it travels in a helical path rather than scraping is calculated basically in the manner illustrated in FIG. 6. In order for the roller 511 to roll smoothly across the surface of the wire as the wire travels through the apparatus, it is apparent that the path of the roller on the wire surface must be linear. Given a roller 511 with a lead angle $\theta$ as shown in FIG. 6, as the roller 511 makes one revolution around the wire, i.e., through the circumferential distance $\pi d$, where $d$ is the diameter of the wire, the wire must move forward in the direction of arrow W a distance equal to $l$. In this manner, the actual path followed by roller 511 will be the hypotenuse of the triangle having a base $\pi d$ and an opposite side $l$. The distance $l$ equals the velocity at which the wire must travel times the time $\Delta T$ with which it takes for the rotor 520 to make one revolution. Since $\Delta T$ equals 60/N, where N is the rpm of rotor 520, the distance $l$ equals the velocity of the wire times 60 divided by N. If we know the diameter of the wire, the velocity at which it is travelling and the number of revolutions which the rotor 520 is making per minute, the angle $\theta$ which rollers 511 should be oriented with respect to the lateral cross-section of the wire W can be calculated in accordance with the formula: $\theta = \text{arc tan}$ $$\left(\frac{V60}{N\pi d}\right).$$

If the velocity of the wire W and the diameter of the wire were constant along its entire length, the angle $\theta$ for all of the rollers 511 would be the same. However, the wire diameter is being continually reduced as the wire travels through self-compensating die 5. Obviously, this varies the diameter factor $d$ of the above formula. It also varies the velocity factor since as the wire is reduced in diameter, its velocity increases. This results from the fact that the volume of wire passing one point, say at the front of self-compensating die 5, in a particular interval of time, must be equal to the volume of wire passing another point, say at the end of self-compensating die 5, in the same interval of time. Assuming the diameter of the wire going into self-compensating die 5 is $d_o$ and the diameter of the wire coming out of self-compensating die 5 is $d_1$, it is apparent that $V_o$, the velocity of the wire at the beginning of self-compensating die 5 must differ from $V_1$, the velocity of the wire at the end of self-compensating die 5, since the following equation must hold:

$$\frac{\pi d_o^2 V}{4} = \frac{\pi d_1^2 V_1}{4}.$$

Thus, $(V_o/V_1) = (d_1^2/d_o^2)$. It is clear, then, that for each point along the length of self-compensating die 5, means must be provided for creating a different angle $\theta$ for each roller 511.

The velocity $V_1$ of the wire at the end of the self-compensating die 5 can be readily calculated as a function of a rate of rotation of the drive reel on drive capstan 6.

$V_1 = RK/60$, where $R$ = the reel rotation in revolutions per minute and $K$ = the circumference of the reel in feet.

The velocity of the wire at any other point in self-compensating die 5 can be determined based on the relative diameters of the wires at the point being determined and at the end of self-compensating die 5 and based on the velocity of the wire at the end of self-compensating die 5 as determined by the above formula. Selecting the velocity $V_o$ at the beginning of the self-compensating die 5, $V_o$ is determined by the following formula:

$$V_o = (d_1^2 RK/d_o^2 60)$$

Given $V_o$ and $d_o$, we can then calculate the required value of $\theta$ for the rollers at the front end of self-compensating die 5 as follows:

$$\theta_o = \text{arc tan } (d_1^2 RK/\pi d_o^3 N)$$

By maintaining the ratio R/N, i.e., the ratio of rate of rotation of drive capstan 6 to the rate of rotation of rotor 520, a constant, one can readily determine the required $\theta$ for any opposing pair of rollers at any point along the length of self-compensating die 5 by putting into the above formula the distance between those rollers and the distance between the last pair of rollers in the self-compensating die 5.

Figure 8:
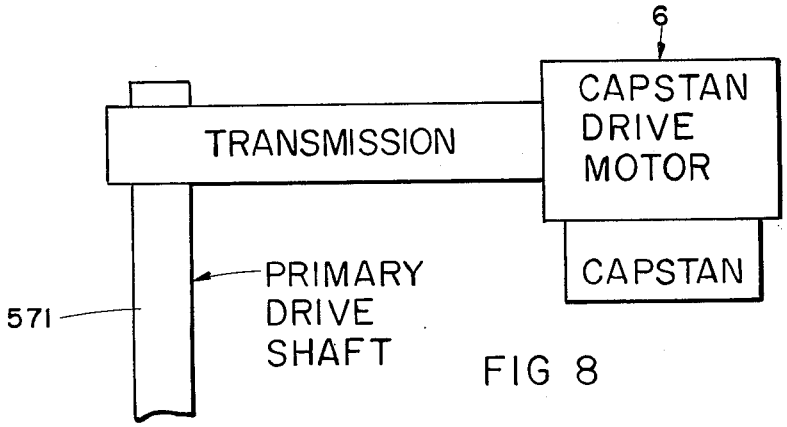
FIG. 8 is a schematic representation of the coordination between the wire drive capstan and the drive shaft for rotating the self-compensating die.

The importance of maintaining a constant ratio between R and N is thus apparent. As a result, the primary drive shaft 571 is driven through conventional transmission means directly off of the drive capstan motor for drive capstan 6. This relationship is illustrated in block form in FIG. 8. The transmission utilized can be a direct mechanical or hydraulic linkage. In the alternative, some type of electronic linkage operating digitally controlled motors could be utilized to effect the transmission between capstan drive motor for capstan 6 and the primary drive shaft 571.

Figure 10:
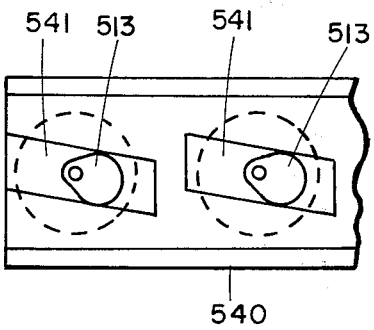
FIG. 10 is a plan view of a section of the cam.
Figure 9:
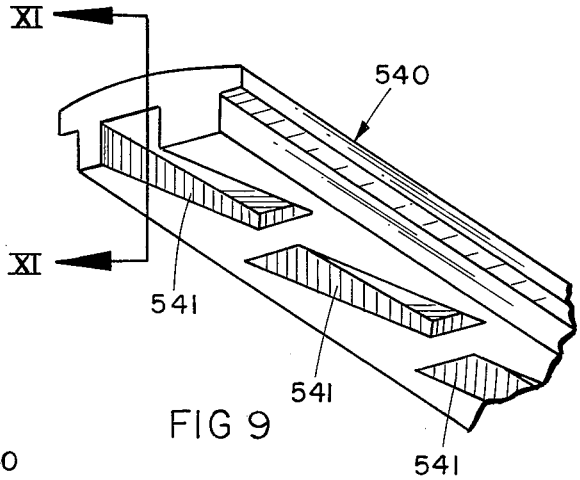
FIG. 9 is a generally perspective view of a cam used to control a group of rollers, taken from a point looking into the cam.
Figure 11:
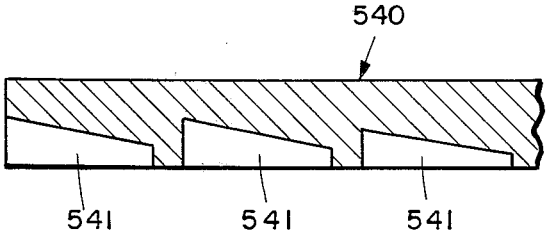
FIG. 11 is a cross-sectional view taken along the plane XI—XI of FIG. 9.

Based on the above discussion of lead angle $\theta$, it will be appreciated that each of the cams 540 must be constructed in accordance with the above-discussed calculations. Referring to FIG. 9, it will be seen that each cam 540 includes a plurality of cam tracks 541 therein. The cam follower 513 on a given roller assembly 510 is received within each cam track 541 generally in the manner illustrated in FIG. 10. As can be seen by reference to FIG. 10, each cam track 541 defines a particular path which the cam follower 513 will follow as cam 540 is moved axially. The lead angle $\theta$ of the roller assembly 510 will be controlled in this manner. The distance of each roller 511 of each roller assembly 510 from the center line of the wire passing through self-compensating die 5 is also determined by its particular cam tract 541. Referring to FIG. 11, it will be seen that each cam track 541 defines an inclined surface so that as cam 540 is moved axially, the relative height of the roller assembly 510 will increase or decrease. Beginning at the left end of self-compensating die 5 as viewed in FIG. 1, each succeeding cam track 541 as one proceeds towards the rear of self-compensating die 5 will be progressively shallower overall so that the cone-like effect illustrated in FIG. 5 will be achieved. The depth for cam tracks 541 are determined based on the shape which the engineer wants to give to the cone illustrated in FIG. 5. To some extent, this shape is limited by the extent to which the wire can be practically reduced by a given pair of opposing rollers acting on it with acceptable compressing pressure.

Given these track depths, the path defined by each cam track 541 across the surface of cam 540 (FIG. 10) must be calculated and defined so as to give its roller 511 the particular lead angle $\theta$ which is required by the roller at that particular track depth as determined by the above $\theta$ formulas. Naturally, the shape given to the cams 513 will also effect this determination of the specific shape to be given the path defined by each cam track 541.

The rotor 520 in which the rollers 510 are carried is forged or machined out of a generally solid cylindrical member (possibly several connected endwise) having a passageway 527 running throughout its length (FIG. 2). Passageway 527 allows the wire W to pass through rotor 520. The rollers 511 extend downwardly into passageway 527 for a distance which is a function of the relative axial position of sleeve 550 and its cams 540 with respect to rotor 520.

The roller assemblies 510 are received in cylindrical-shaped apertures 521 in rotor 520. The roller assemblies 510 are free to move vertically up or down and are free to rotate within their receiving apertures 521.

Rotor 520 includes a bearing cone 522 projecting from each end thereof and being received in a hydrostatic bearing 523 mounted to the base of the apparatus. The passageway 527 extends through each bearing cone 522 as well.

An axial keyway 524 in the exterior surface of rotor 520 receives the key 551 which locks sleeve 550 to simultaneous rotation with rotor 520. Keyway 524 is sufficiently long that axial shifting of sleeve 550 with respect to rotor 520 can be effected.

Figures 3, 4:
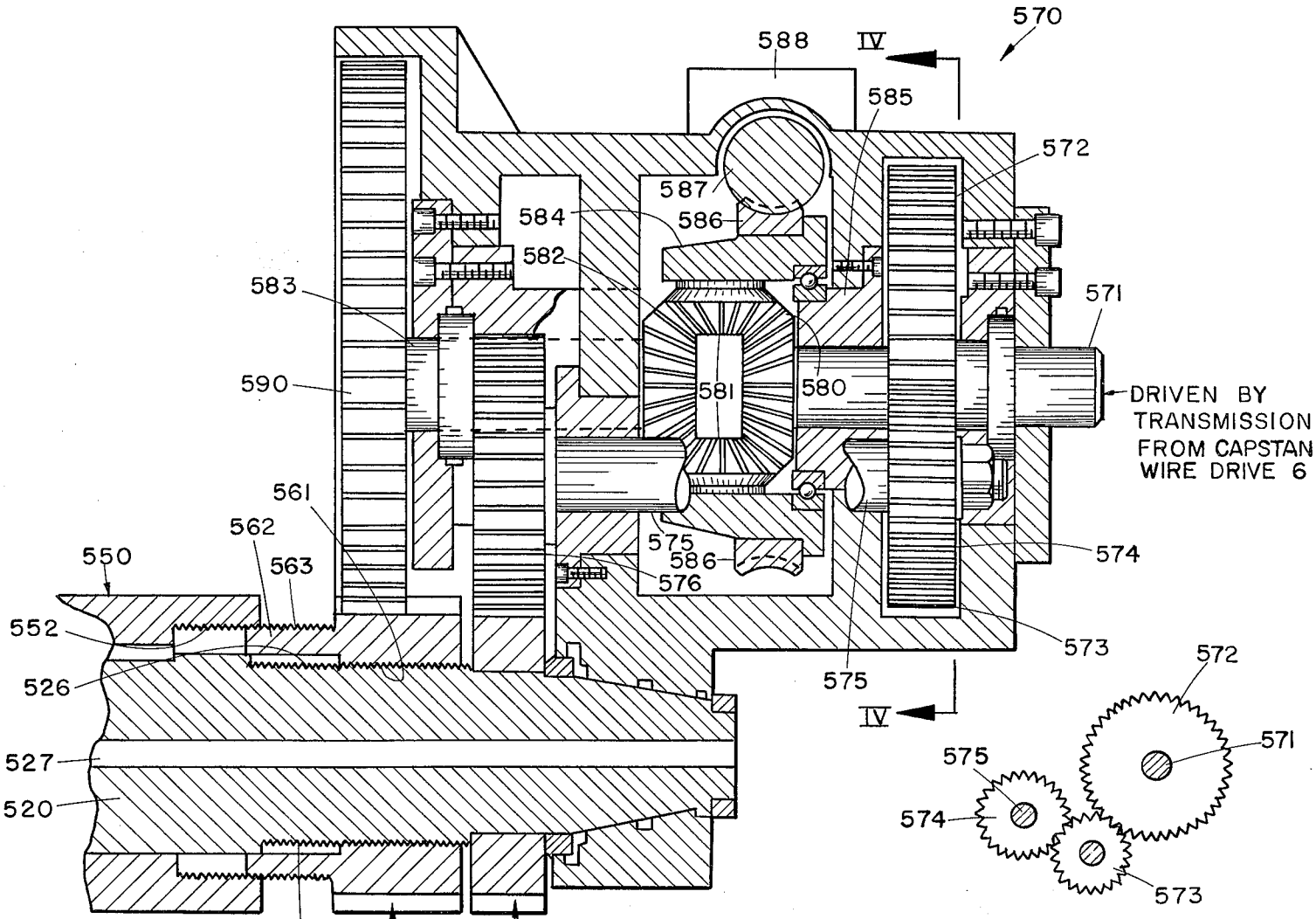
FIG. 3 is a cross-sectional view of the differential control system 570 for the self-compensating die.
FIG. 4 is a cross-sectional view taken along plane IV—IV of FIG. 3.

Rotor 520 includes a threaded end 526 upon which adjustment gear 560 is threadably received (FIGS. 2 and 3). Finally, rotor 520 is keyed by key 525 to rotation with its rotor drive gear 530 (FIG. 2). The two rotate simultaneously and are locked against axial displacement with respect to one another.

Sleeve 550 is cylindrical in configuration and includes a key 551 extending downwardly into keyway 524 of rotor 520 (FIG. 2). The rear end of sleeve 550 is threaded on the inside surface thereof at threads 552 (FIG. 3). The pitch of the threads 552 differs from the pitch of the threads 526 such that when adjusting gear 560 is rotated relative to rotor 520 and sleeve 550, sleeve 550 and rotor 520 are axially displaced relative to one another.

Adjusting gear 560 includes a set of inner threads 561 threaded on threads 526 of rotor 520 (FIG. 3). It also includes an extension cylinder 562 threaded on its exterior with outer threads 563 which are threadably engaged with the threads 552 on sleeve 550.

Differential assembly 570 inlcudes a primary drive shaft 571 which is driven by a transmission from the drive for capstan wire drive 6. As noted above, it is important that the rate of rotation of rotor 520 and sleeve 550 be proportional to the rate at which wire is pulled therethrough since the angle $\theta$ of the roller assemblies 510 to the lateral cross section of the wire is a function of the diameter of the wire, the speed with which the wire is moved, and the rate at which the rotor 520 and sleeve 550 are rotating. By locking the wire drive and the rotor drive with respect to one another, this angle $\theta$ for each of the different pairs of rollers 510 remains constant for a given position of the rotor with respect to its particular cam 540.

Primary drive shaft 571 drives rotor drive gear 530 through a primary drive gear 572, which in turn drives idler gear or reversing gear 573, which in turn drives a secondary drive gear 574 on a secondary drive shaft 575 and through a third drive gear 576 mounted on the end of secondary drive shaft 575. Third gear 576 then directly drives rotor drive gear 530. Primary drive gear 572, idler drive gear 573, and secondary drive gear 574 are also shown in FIG. 4.

Primary drive shaft 571 is also connected directly to the input pinion 580 of a differential gear unit. Input pinion 580 drives carrier or spider gears 518 which in turn drive an output pinion 582. An output shaft 583 extends from output pinion 582 and drives an output drive gear 590 which in turn drives adjusting gear 560.

The carrier gears 581 are rotatably mounted on the carrier 584 which is in turn rotatably mounted on a bearing 585 for primary drive shaft 571. Carrier 584 includes a circumferential worm track 586 which is engaged by a worm 587. Worm 587 is driven by a stepper motor 588 in accordance with a control signal indicating that cams 540 and thereby the relative radial positions and angles $\theta$ of roller assemblies 510 should be changed.

Figure 12:
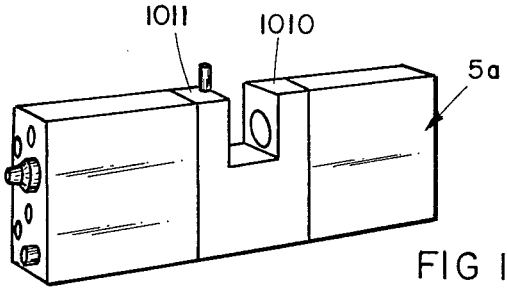
FIG. 12 is a perspective view of the wire gauging means employed in the apparatus of the present invention.

FIG. 12 discloses an electronic wire gauge *5a* which is mounted at the rear end of self-compensating die 5 to gauge the diameter of wire W as it leaves self-compensating die 5 (see also FIG. 2). It is a conventional device operating on a photoelectric principle by passing light in a plane across the path which the wire follows. Basically, the wire W passes between a light-generating cell 1010 and a light-receiving cell 1011. Conventional wire measuring devices of this type are available from companies such as The Electron Machine Corporation.

Figure 13:
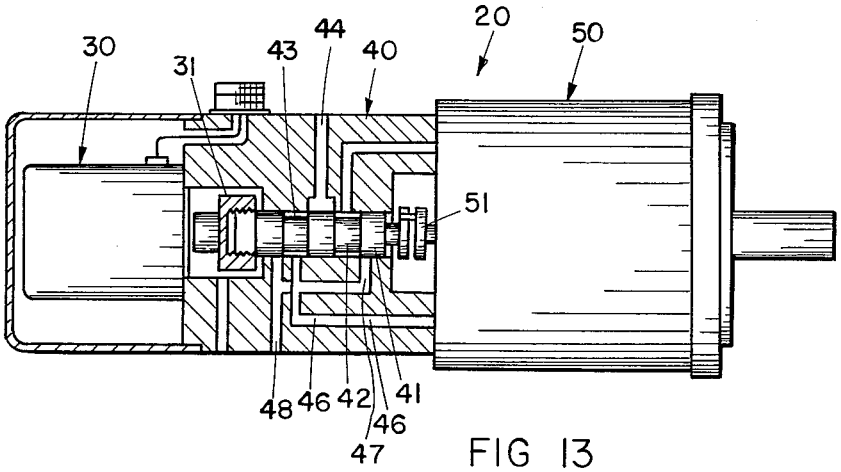
FIG. 13 is a partially cross-sectional view of an electro-hydraulic stepper motor used to drive wire drive capstan 6.

FIG. 13 discloses an electro-hydraulic stepper motor 20 which can be conveniently used to drive capstan 6. The advantage of such a motor is that it provides a high torque output by way of its hydraulic motor and provides a convenient means of control by reason of its electro-stepper motor. Motor 20 comprises an electrical stepper motor 30, a servo valve control 40, and hydraulic motor 50. Such electro-hydraulic stepper motors are conventional and are available from companies such as Washington Scientific Instruments, Inc. Servo valve 40 includes a spool 41 which is coupled to the drive shaft 51 of hydraulic motor 50 such that it rotates therewith, but such that it is capable of sliding axially with respect thereto. At its other end, spool 41 is threadably received in a "rotary-linear translator" 31 mounted on the output shaft of stepper motor 30. Any difference in the rate of rotation of hydraulic motor 50 and stepper 30 will cause spool valve 41 to shift either to the left or to the right opening of either channel 42 or 43 to oil inlet port 44. The oil then flows either through passageway 45 or 46, through hydraulic motor 50 and then out through the other of passageway 45 or 46 and through either return passageway 47 or 48. Assuming the flow through passageway 45 drives hydraulic motor 50 in a clockwise direction, and assuming that stepper motor 30 experiences an acceleration in the receipt of electrical pulses and thereby begins stepping at a faster rate in a clockwise direction, spool 41 will thread to the left in translator 31, causing more oil to flow into channel 42 and from thence into passageway 45, thereby causing hydraulic motor 50 to speed up accordingly. The reverse possibility will also be appreciated by those skilled in the art.

SELF-COMPENSATING DIE CONTROL

Figure 14:
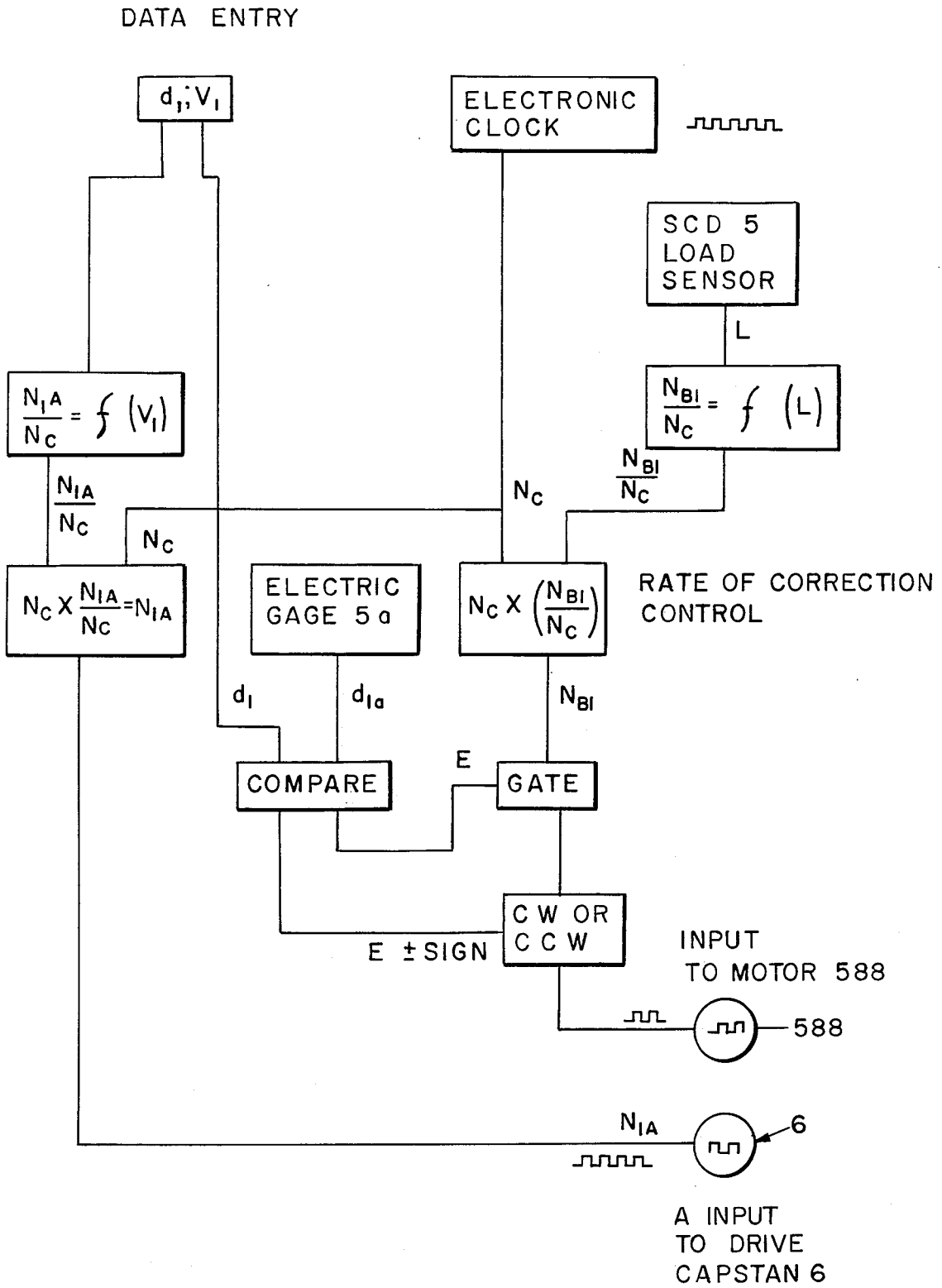
FIG. 14 is a logic diagram for control of the self-compensating die.

A logic circuit for controlling self-compensating die 5 is disclosed in FIG. 14. The desired final wire diameter $d_1$ and the velocity $V_1$ at which wire is to be processed over drive capstan 6 are entered into the data entry circuit at the top of FIG. 14. Information as to the velocity $V_1$ is fed into a logic circuit for determining the ratio of the rate of revolution $N_{1A}$ of drive capstan 6 relative to the rate of $N_c$ of emission of the pulses from an electronic clock. The resulting ratio $N_{1A}/N_c$ is fed into a logic circuit which also receives the pulse signal $N_c$ from the electronic clock. The circuit is a multiplier circuit which multiplies $N_{1A}/N_c$ by $N_c$ to thereby yield a pulse signal $N_{1A}$. This pulse signal $N_{1A}$ is used to drive an electro-hydraulic stepper motor 20 for drive capstan 6.

Stepper motor 588 for effecting control of differential assembly 570 is driven as a function of the error between the actual wire diameter $d_{1a}$ of wire leaving self-compensating die 5 as determined by gauge *5a* and the desired wire diameter $d_1$ at that point.

The error E beween the actual wire diameter $d_{1a}$ and the desired wire diameter $d_1$ at electronic gauge *5a*, as established by a comparator circuit, is fed to the base of a gate and a signal indicating the polarity or sign on the error is fed to a reversing circuit capable of generating a clockwise or a counterclockwise motion in stepper motor 588. If there is an error, the gate will be opened and a correcting signal $N_{B1}$ generated from a rate of correction control logic circuit will be transmitted through the gate and through the polarity control circuit CW or CCW to thereby generate a clockwise or counterclockwise signal for driving stepper motor 588. The rate of correction control signal $N_{B1}$ is generated as a function of the load on self-compensating die 5. Self-compensating die 5 includes a stress gauge or "load sensor" located therein to sense the load which is being imposed thereon as a result of the action of the roller assemblies 510 on the wire passing therethrough. This load signal L is fed to a logic circuit for generating a signal representing the ratio of $N_{B1}$ to the pulses $N_c$ being generated by the electric clock referred to in FIG. 14. The pulses representing the ratio of $N_{B1}$ to $N_c$ are then fed to a multiplier circuit along with the signals from the electric clock $N_c$ and the resulting $N_{B1}$ signal is fed to the gate. The larger the load on the load sensor for self-compensating die 5, the smaller will be $N_{B1}$. The smaller the load, the larger $N_{B1}$. Thus, when the self-compensating die 5 is just starting up, the load will be zero, electric gauge *5a* will naturally measure an error between $d_{1a}$ and the desired diameter $d_1$, and a signal of a large magnitude will be fed to stepper motor 588. As stepper motor 588 rotates worm 587, thereby effecting an adjustment of the rollers 510 inwardly, the pressure or load on self-compensating die 5 will buildup and the pulse rate $N_{B1}$ will accordingly begin to slow down. As one approaches the point where there is no error E between $d_{1a}$ and $d_1$, magnitude of the signal $N_{B1}$ will be quite small because of the increased pressure being sensed by the load sensor. When there is no error E between $d_{1a}$ and $d_1$, the gate will, of course, close and no signal $N_{B1}$ will be transmitted to motor 588 regardless of the then magnitude of signal $N_{B1}$.

OPERATION

In operation, a wire W is first threaded through the passageway 527 in self-compensating die 5. The operator enters data as to the desired velocity $V_1$ with which the wire is to be pulled over capstan 6 and the desired wire diameter $d_1$ which the wire is to have after it leaves self-compensating die 5. The wire velocity $V_1$ selected will be based upon the desired rate of production, within the limits of the operability of the self-compensating die 5. With the wire thus threaded and the starting information thus entered, the operator will start the apparatus.

The apparatus will immediately sense an error in the wire diameter as it passes through gauge *5a*. At the outset, gauge *5a* will sense the initial starting diameter $d_o$ of the wire. There will thus be an error between $d_{1a}$, the diameter as actually measured, and the desired wire diameter $d_1$. This will allow a rate of correction control signal $N_{B1}$ to be fed to electronic stepper motor 588 for driving worm 587 and thereby rotating carrier 584 (FIG. 3). As a result, sleeve 550 will shift axially with respect to rotating rotor 520 and the cam 540 connected to sleeve 550 will cause the roller assemblies 510 to move inwardly into compressively engaging relationship with the wire W. This initial movement will be relatively rapid since initially, there will be no substantial loads sensed by the load sensor of self-compensating die 5. As the various rollers 511 engage the wire, however, pressures will build up and the rates of pulses $N_{B1}$ will begin to slow down. Eventually, when the actual wire diameter $d_{1a}$ sensed by electric gauge 5*a* corresponds to the desired wire diameter $d_1$, the gate allowing the correction control $N_{B1}$ circuit to motor 588 will close. At this time, signals $N_{B1}$ will not be transmitted in motor 588 and sleeve 550 will, therefore, cease to shift axially. Sleeve 550 and rotor 520 on the one hand adjusting gear 560 on the other will then continue to rotate at the same speed and in the same direction until an error is again sensed by the system.

Naturally, variations occurring in the actual wire diamter $d_{1a}$ will be detected and the apparatus will be controlled in the above manner in accordance with any errors sensed. In this manner, the wire diameter $d_{1a}$ is closely controlled so that self-compensating die 5 produces a reduced diameter wire from a particular starting wire or green stock within closely controlled tolerances.

Further, these results are achieved using simple right cylindrical rollers. No specifically profiled surface need be ground onto the rollers. This also makes the die operable over a large range of possible reductions.

Of course, it will be understood that the above is merely a preferred embodiment of the invention and that various changes and alterations can be made without departing from the spirit and broader aspects of the invention.

The embodiments of the invention in which an exclusive property or privilege is claimed are defined as follows:

1. Apparatus for reducing the cross section of rod, wire or like material comprising: rotor means having a longitudinally axial passageway therethrough through which material can pass and about which said rotor means is rotatably mounted; a plurality of sets of separate roller assemblies, each set including at least two of said roller assemblies, each of said roller assemblies including a roller mouting means and a roller rotatably mounted on said roller mounting means; each said roller mounting means being generally radially movably mounted in said rotor means whereby its roller can be moved towards or away from the longitudinal axis of said axial passageway; said roller mounting means also being rotatably mounted in said rotor means whereby the angle of orientation of said roller with respect to said axial passageway can be adjusted by rotating said roller mounting means through a particular angle of adjustment; said sets of roller assemblies being mounted in spaced relationship along the length of said rotor means said rollers located contiguous with said axial passageway for engaging material passing therethrough and with said rollers in said sets of roller assemblies being located closer to the longitudinal axis of said axial passageway as one proceeds along the length of said rotor means from the front thereof to the rear; and drive means for rotating said rotor and accordingly said rollers about the material as the material passes through said axial passageway; radial position control means operably connected to said plurality of roller assemblies for controlling the position of said rollers radially with respect to said axial passageway; angular control means operably connected to said plurality of roller assemblies for controlling the angular position of said rollers with respect to the longitudinal axis of said axial passageway whereby the angle which said rollers make with respect to wire passing through said axial passageway can be adjustably controlled.

2. The apparatus of claim 1 in which said radial position control means and said angular position control means are operably interconnected at least for each said roller assembly such that the angle of orientation of each said roller is established as a function of its radial position.

3. The apparatus of claim 2 in which said radial position control means and said angular position control means comprise means for adjusting all of said roller assemblies simultaneously.

4. The apparatus of claim 1 which includes: sleeve means axially movably mounted about said rotor means and keyed to said rotor means for rotational movement therewith; said radial position control means and said angular control means both including cam means positioned within said sleeve and operably engaging said plurality of roller means, said cam means defining a cam track for each said roller means, the slope of said track providing radial position control and the path of said track providing angular adjustment control; each said roller means including a cam follower engaging said cam track; adjustment means for axially shifting said sleeve means with respect to said roller means to thereby move said cams with respect to said roller means and thereby effect adjustment of said roller means in response to movement of said cam means.

5. The apparatus of claim 1 including wire drive means for pulling wires through said axial passageway of said rotor, said wire drive means being operably connected to said rotor drive means for rotating said rotor at a rate of rotation which is directly proportional to the rate at which wire is being pulled through said rotor.

6. Apparatus for reducing the cross section of rod, wire or like material comprising: rotor means having an axial passageway therethrough through which material can pass and about which said rotor means is rotatably mounted; a plurality of roller means, each including at least one roller, mounted in said rotor means with said rollers located contiguous with said axial passageway for engaging material passing therethrough; and drive means for rotating said rotor and accordingly said rollers about the material as the material passes through said axial passageway; each of said roller means being generally radially movably mounted in said rotor means whereby its roller can be moved towards or away from the center line of said axial passageway, said apparatus including radial position control means operably connected to said plurality of roller means for controlling the position of said rollers radially with respect to said axial passageway; each of said roller means being rotatably mounted within said rotor means such that the angle of the roller of the roller means with respect to the longitudinal axis of the axial passageway can be adjusted; angular control means operably connected to said plurality of roller means for controlling the angular position of said rollers with respect to the longitudinal axis of said axial passageway whereby the angle which said rollers make with respect to wire passing through said axial passageway can be adjustably controlled; sleeve means axially movably mounted about said rotor means and keyed to said rotor means for rotational movement therewith; said radial position control means and said angular control means both including cam means positioned within said sleeve and operably engaging said plurality of roller means, said cam means defining a cam track for each said roller means, the slope of said track providing radial position control and the path of said track providing angular adjustment control; each said roller means including a cam follower engaging said cam track; adjustment means for axially shifting said sleeve means with respect to said roller means to thereby move said cams with respect to said roller means and thereby effect adjustment of said roller means in response to movement of said cam means.

7. The apparatus of claim 6 in which both said radial position control means and angular adjustment control means include: sensing means positioned downstream of said axial passageway with respect to the direction of travel of wire through said axial passageway for sensing the actual diameter of the wire as it leaves said axial passageway and said rotor; first logic control means operably connected to said sensing means and to said adjustment means for comparing the actual material cross section as determined by said sensing means with a predetermined desired material cross section and for effecting operation of said adjustment means in response to any differences therebetween to thereby shift said sleeve and said cams relative to said rotor means to effect an adjustment of said rollers.

8. The apparatus of claim 7 in which said adjustment means is threadably mounted on said rotor means and threadably mounted to said sleeve means, the thread pitch of said threadable mounting to said rotor means being different from the thread pitch of said threadable mounting to said sleeve means; said adjustment means being rotatably driven by said drive means for normally rotating said adjusting means at the same rate as said rotor means; differential input means operably connected to said adjustment means for varying the rate of rotation of said adjustment means with respect to the rate of rotation of said rotor means whereby said sleeve will move axially with respect to said rotor means when said adjustment means is differentially rotated with respect thereto; said differential input means being operably connected to said first logic means for operation upon receipt of a signal indicating a difference between the actual wire diameter and the desired wire diameter.

9. The apparatus of claim 8 including adjustment rate-control means for controlling the rate at which said differential input means operates to thereby control the rate of change in the relative position of said rollers within said rotor; load sensing means operably connected to said roller means for sensing the load being imposed by said rollers of said roller means on material passing through said rollers, said load sensing means being operably connected to said adjustment rate control means; said adjustment rate control means including second logic means operably connected to said differential input means for operating said differential input means at a rate inversely proportional to the load sensed by said load sensing means whereby when the load sensed is slight, the rate of adjustment of said adjustment means will be greater and when said load sensed is greater, said rate of adjustment will be lesser.

10. The apparatus of claim 9 in which said drive means is operably connected to a primary drive input shaft; said primary drive input shaft being operably connected to said rotor means for effecting rotation of said rotor means and its associated sleeve means; said differential input means comprising a mechanical differential operably connected to and driven by said primary drive input shaft, said mechanical differential including a pinion output shaft operably connected to said adjusting means for rotatably driving said adjusting means at the same rate of rotation as said rotor means; said differential including a carrier operably connected to said primary drive input shaft and to said pinion output shaft, said carrier having a circumferential worm gear track operably engaged by a worm driven by a differential input motor, said differential input motor being operably connected to said first and second logic means.

11. The apparatus of claim 10 in which said second logic means is operably connected to said differential input motor through a gate circuit which is operably connected to said first logic means for opening in response to a signal from said first logic means indicating an error in material thickness.

12. The apparatus of claim 10 including wire drive means for pulling wire through said axial passageway of said roller means; said wire drive means being operably connected to and driven by said drive means.

13. The apparatus of claim 12 in which said roller means are arranged in opposing pairs; said cam means being so constructed that the distance between the rollers in each roller pair decreases as one proceeds down the length of said rotor means from the upstream end thereof to the downstream end thereof; said cam means also having a configuration which enables the operator to simultaneously change the distance between all of the pairs of rollers upon movement of said cam means with respect to said roller means whereby the number of rollers engaging a wire passing through said axial passageway and the radial position of the rollers can be varied.

14. The apparatus of claim 13 in which said cam means are so configured as to give the rollers in each roller pair a different angle with respect to the longitudinal axis of said axial passageway for each different distance between opposing rollers in a roller pair, said angle in each case being a function of the distance between the rollers in each roller pair.

15. The apparatus of claim 6 in which said adjustment means is threadably mounted on said rotor means and threadably mounted to said sleeve means, the thread pitch of said threadable mounting to said rotor means being different from the thread pitch of said threadable mounting to said sleeve means; said adjustment means being rotatably driven by said drive means for normally rotating said adjusting means at the same rate as said rotor means; differential input means operably connected to said adjustment means for varying the rate of rotation of said adjustment means with respect to the rate of rotation of said rotor means whereby said sleeve will move axially with respect to said rotor means when said adjustment means is differentially rotated with respect thereto.

16. The apparatus of claim 15 in which said drive means is operably connected to a primary drive input shaft; said primary drive input shaft being operably connected to said rotor means for effecting rotation of said rotor means and its associated sleeve means; said differential input means comprising a mechanical differential operably connected to and driven by said primary drive input shaft, said mechanical differential including a pinion output shaft operably connected to said adjusting means for rotatably driving said adjusting means at the same rate of rotation as said rotor means; said differential including a carrier operably connected to said primary drive input shaft and to said pinion output shaft, said carrier having a circumferential worm gear track operably engaged by a worm driven by a differential input motor.

17. Apparatus for reducing the cross section of rod, wire or like material comprising: rotor means having an axial passageway therethrough through which material can pass and about which said rotor means is rotatably mounted; a plurality of roller means, each including at least one roller, mounted in said rotor means with said rollers located contiguous with said axial passageway for engaging material passing therethrough; and drive means for rotating said rotor and accordingly said rollers about the material as the material passes through said axial passageway; wire drive means for pulling wire through said axial passageway of said roller means; said wire drive means being operably connected to and driven by said drive means; said roller means being arranged in opposing pairs with the distance between the rollers in each roller pair decreasing as one proceeds down the length of said rotor means from the upstream end thereof to the downstream end thereof; control means for enabling the operator to simultaneously change the distance between all of the pairs of rollers whereby the number of rollers engaging a wire passing through said axial passageway and the radial position of the rollers can be varied.

18. The apparatus of claim 17 in which each of said rollers is a right cylindrical roller.

19. Apparatus for reducing the cross section of rod, wire or like material comprising: rotor means having an axial passageway therethrough through which material can pass and about which said rotor means is rotatably mounted; a plurality of roller means, each including at least one roller, mounted in said rotor means with said rollers located contiguous with said axial passageway for engaging material passing therethrough; and drive means for rotating said rotor and accordingly said rollers about the material as the material passes through said axial passageway; each of said rollers being a right cylindrical roller.

20. Apparatus for reducing the cross section of rod, wire or like material comprising: rotor means having an axial passageway therethrough through which material can pass and about which said rotor means is rotatably mounted; a plurality of roller means, each including at least one roller, mounted in said rotor means with said rollers located contiguous with said axial passageway for engaging material passing therethrough; and drive means for rotating said rotor and accordingly said rollers about the material as the material passes through said axial pasageway; said roller means being movably positioned in said rotor means for adjustment therein; sleeve means axially movably mounted about said rotor means and keyed to said rotor means for rotational movement therewith, said sleeve means including cam means operably engaging said roller means to control the position of said roller means in said rotor means; adjustment means for axially shifting said sleeve means with respect to said roller means to thereby move said cam means with respect to said roller means and thereby effect adjustment of the relative position of said roller means in said rotor means.

21. The apparatus of claim 20 including adjustment means operably connected to said sleeve means for effecting adjustment of the axial position of said sleeve means with respect to said rotor means.

22. The apparatus of claim 21 including: adjustment rate control means for controlling the rate at which said adjustment means is operated to adjust the axial position of said sleeve means; load sensing means operably connected to said roller means for sensing the load being imposed by said rollers of said roller means on a material passing through said rollers, said load sensing means being operably connected to said adjustment rate control means; said adjustment rate control means including logic means operably connected to said adjustment means for operating said adjustment means at a rate inversely proportional to the load sensed by said load sensing means whereby when the load sensed is slight, the rate of adjustment of said adjustment means will be greater and when said load sensed is greater, said rate of adjustment will be lesser.

23. The apparatus of claim 22 in which said adjustment means is threadably mounted on said rotor means and threadably mounted to said sleeve means, the thread pitch of said threadable mounting to said rotor means being different from said pitch of said threadable mounting to said sleeve means; said adjustment means being rotatably driven by said drive means for normally rotating said adjusting means at the same rate as said rotor means; differential input means operably connected to said adjustment means for varying the rate of rotation of said adjustment means with respect to the rate of rotation of said rotor means whereby said sleeve will move axially with respect to said rotor means when said adjustment means is differentially rotated with respect thereto; said logic means of said adjustment rate control means being operably connected to said differential input means to thereby effect said operable connection between said logic means and said adjustment means.

24. The apparatus of claim 23 in which a material cross-section sensing means is positioned at the downstream end of said apparatus to sense the cross-section of material after it has passed through said apparatus; cross-section logic control means operably connected to said sensing means for comparing the actual material cross-section as determined by sensing means with a predetermined desired material cross-section; said material cross-section logic control means being operably connected to a gate means; said logic means of said adjustment rate control means being operably connected to said adjustment means through said gate means whereby adjustment in accordance with said adjustment rate control means is effected only upon receipt of a signal from said cross-section control logic means indicating the existence of a difference between the actual material cross-section and the desired material cross-section.

25. The apparatus of claim 22 in which a material cross-section sensing means is positioned at the downstream end of said apparatus to sense the cross-section of material after it has passed through said apparatus; cross-section logic control means operably connected to said sensing means for comparing the actual material cross-section as determined by sensing means with a predetermined desired material cross-section; said material cross-section logic control means being operably connected to a gate means; said logic means of said adjustment rate control means being operably connected to said adjustment means through said gate means whereby adjustment in accordance with said adjustment rate control means is effected only upon receipt of a signal from said cross-section control logic means indicating the existence of a difference between the actual material cross-section and the desired material cross-section.

26. The apparatus of claim 20 comprising: said cam means having a configuration which positions said rollers radially closer to the axis of rotation of said rotor means as one proceeds along the length of said rotor means from the front thereof to the rear.

27. The apparatus of claim 26 in which said roller means are arranged in pairs diametrically opposing one another on opposite sides of said axial passageway.

28. The apparatus of claim 27 in which adjacent ones of said roller pairs are positioned in said rotor at different radial angles with respect to one another.

29. The apparatus of claim 28 in which said different radial angles are 90° apart.

30. Apparatus for for reducing the cross section of rod, wire or like material comprising: rotor means having an axial passageway therethrough through which material can pass and about which said rotor means is rotatably mounted; a plurality of roller means, each including at least one roller, mounted in said rotor means with said rollers located contiguous with said axial passageway for engaging material passing therethrough; and drive means for rotating said rotor and accordingly said rollers about the material as the material passes through said axial passageway; said roller means being arranged in pairs diametrically opposing one another on opposite sides of said axial passageway; adjacent ones of said roller pairs being positioned in said rotor at different radial angles with respect to one another.

31. The apparatus of claim 30 in which said different radial angles are 90° apart.

32. The apparatus of claim 30 in which said roller means are positioned radially closer to the axis of rotation of said rotor means as one proceeds along the length of said rotor means from the front thereof to the rear.

33. An apparatus for reducing the cross-section of a material passing therethrough comprising: a plurality of compressive rollers for applying a compressive force to a material passing through the apparatus; sensing means for sensing the cross-section of a material after it passes said compressive rollers and has been reduced thereby; roller positioning means for adjusting the relative positions of said compressive rollers to increase or decrease the position of the rollers relative to the material passing therethrough and to thereby change the extent to which said material is reduced in cross-section by said compressive rollers; roller position control means operably connected to said roller positioning means and to said sensing means for comparing the actual cross-section of the material as sensed by said sensing means with a predetermined desired cross-section and for controlling said roller positioning means in response to the difference between said actual cross-section and said predetermined desired cross-section; rate control means operably connected to said roller positioning means for controlling the rate at which said roller positioning means are adjusted in response to signals from said positioning control means, said rate control means including: load sensing means for sensing the pressure being applied by said compressive rollers to the material passing thereby and a first logic means for generating a rate control signal for controlling the rate of adjustment of said positioning control means as an inverse function of the pressure sensed by said load sensing means whereby when the pressure sensed is small, said positioning control means will operate at a relatively rapid rate to adjust said rollers and when the pressure is great, said positioning control means will operate at a relatively slower rate.

34. The apparatus of claim 33 which includes: gate means; said rate control means being operably connected to said roller positioning means through said gate means; said roller position control means being operably connected to said gate means for opening said gate means in response to a determination that the actual material cross-section differs from the predetermined desired cross-section and for closing said gate means in response to a determination that said actual material cross-section equals said desired material cross-section.

35. A method for reducing the cross-section of rod, wire or like material comprising: rolling a plurality of rollers around the material such that each define a generally helical path on the surface of the material while simultaneously moving the material with respect to the rollers in a direction opposite to that in which the generally helical paths are being generated; positioning the rollers at a particular radial position with respect to the center line of the material passing therethrough and at a particular angle with respect to the lateral cross-section of the material passing therethrough which position is, for each roller, a function of the desired cross-sectional reduction in the material which is sought for the material at the location of each said roller.

36. The method of claim 35 which includes the step of arranging said rollers in oppositely facing pairs.

37. The method of claim 36 which includes the step of arranging said pairs of rollers such that at least adjacent pairs are at different angles with respect to one another as viewed from the plane of the lateral cross-section of the material passing between the rollers.

38. The method of claim 37 in which said roller pairs are arranged to be spaced at different distances apart, and at distances which decrease as one proceeds in the direction which the material passes between said roller sets.

39. The method of claim 38 performed on wire.

* * * * *